US006250294B1

(12) United States Patent
Lim

(10) Patent No.: US 6,250,294 B1
(45) Date of Patent: Jun. 26, 2001

(54) AIR COMPRESSION TYPE SHOOTING DEVICE USING ADHESION TYPE BULLET

(76) Inventor: Bak Gyu Lim, 221-3 Suckchon-dong, Songpha-gu, Seoul (KR)

( * ) Notice: Subject to any disclaimer, the term of this patent is extended or adjusted under 35 U.S.C. 154(b) by 0 days.

(21) Appl. No.: 09/411,928

(22) Filed: Oct. 4, 1999

(51) Int. Cl.[7] ..... F41B 11/14
(52) U.S. Cl. ..... 124/66; 124/56; 124/65
(58) Field of Search ..... 124/66, 63, 67

(56) References Cited

U.S. PATENT DOCUMENTS 2,213,318 * 9/1940 Lefever .
3,859,977 * 1/1975 Lange .
4,819,609 * 4/1989 Tippmann .
4,850,329 * 7/1989 Taylor et al. .
5,184,755 2/1993 Brovelli ..... 222/79
5,186,156 2/1993 Clayton ..... 124/59
5,261,384 * 11/1993 Hu .
5,267,549 12/1993 Webber ..... 124/65
5,377,655 * 1/1995 Arad .
5,429,108 7/1995 Hsieh ..... 124/65
5,570,676 * 11/1996 Gore .
5,622,159 * 4/1997 Lin et al. .
5,653,215 * 8/1997 Chung et al. .
5,724,954 * 3/1998 Smith .
5,738,079 * 4/1998 Keller et al. .
5,791,326 * 8/1998 Brown et al. .
5,901,693 * 5/1999 Smith .
5,975,068 * 11/1999 Halter et al. .
5,988,152 * 11/1999 Halter et al. .
6,067,975 * 5/2000 Ginn .

* cited by examiner

*Primary Examiner*—Charles T. Jordan
*Assistant Examiner*—Troy Chambers
(74) *Attorney, Agent, or Firm*—Eric Bleich

(57) ABSTRACT

The present invention relates to an air compression type shooting device comprising: a fixed compression tube having a rubber ring for holding a bullet attached to the end thereof; a movable compression tube placed movably back and forth by the rear grip and the spring in the fixed compression tube; a piston biased by the spring in the movable compression tube and moved back and forth in a guide tube to inhale and compress the air; and a trigger for holding and releasing the piston. According to the present invention, the bullet having velcro fabrics attached thereto is discharged toward a target made of velcro fabrics by means of the air compression so that the bullet is attached to the target, whereby it is possible to confirm the point of impact, there is no risk to lose the bullet, it is possible to discharge the bullet more accurately, and a weight is put inside the bullet to increase the distance of discharge, and by which a person is not injured or a fragile article is not damaged by means of the shock-absorbing materials even when the bullet is discharged toward the person or the fragile article, the target being made of velcro fabrics so that a player can aim the target and shoot the bullet to confirm the point of impact just alone.

7 Claims, 4 Drawing Sheets

AIR COMPRESSION TYPE SHOOTING DEVICE USING ADHESION TYPE BULLET

BACKGROUND OF THE INVENTION

1. Field of the Invention

The present invention relates to an air compression type shooting device, and more particularly to an air compression type shooting device in the form of a gun, by which a bullet having velcro fabrics attached thereto is discharged toward a target made of velcro fabrics by means of the air compression so that the bullet is attached to the target, whereby it is possible to confirm the point of impact, there is no risk to lose the bullet, it is possible to use it more safely with improved shooting efficiency, and a weight is put inside the bullet to increase the distance of discharge.

2. Description of the Prior Art

Up to now, a lot of air compression type shooting device have been developed and used. However, most of them commonly use compressed air to discharge a bullet made of synthetic resin. In addition, there is provided an absorption type shooting device using absorption members by which the discharged bullet is attached to the smooth surface such as a glass surface.

Furthermore, there is developed a throwing game using velcro fabrics, by which one throw a ball made of velcro fabrics to the other who receive then the ball with a receiver made of velcro fabrics.

These air compression type shooting devices are used commonly by the children, which have both safety and pleasure.

Among the playing game, however, the air compression type shooting device using the bullet made of synthetic resin uses the compressed air to increase the shooting efficiency. As a result, the shooting efficiency is increased, whereas such a shooting device has an disadvantage that a person or a domestic animal may be injured or a fragile article may be damaged when the bullet is discharged toward the person, the animal or the fragile article. In addition, the discharged bullets are difficult to collect, so the environment may be soiled. Furthermore, the economical loss may be caused because new bullets frequently need to be bought.

Meanwhile, the throwing game using velcro fabrics usually can be used by two persons. This game may not be played indoor since it is restricted by the place. And it can not stimulate interest in playing the game because it has no target.

SUMMARY OF THE INVENTION

It is an object of the present invention to eliminate the aforesaid problems.

It is another object of the present invention to provide an air compression type shooting device using adhesion type bullet, by which the bullet having velcro fabrics attached thereto is discharged toward a target made of velcro fabrics by means of the air compression so that the bullet is attached to the target, whereby it is possible to confirm the point of impact, there is no risk to lose the bullet, it is possible to discharge the bullet more accurately, and a weight is put inside the bullet to increase the distance of discharge, and by which a person is not injured or a fragile article is not damaged by means of the shock-absorbing materials even when the bullet is discharged toward the person or the fragile article, the target is made of velcro fabrics so that a player can aim the target and shoot the bullet to confirm the point of impact just alone, and it is possible to use various colored bullets so that several people can shoot the bullet toward the target to compare his score with others.

In order to accomplish the aforesaid object, it is provided an air compression type shooting device comprising: a fixed compression tube having a rubber ring for holding a bullet attached to the end thereof; a movable compression tube placed movably back and forth by the rear grip and the spring in the fixed compression tube; a piston biased by the spring in the movable compression tube and moved back and forth in a guide tube to inhale and compress the air; and a trigger for holding and releasing the piston.

BRIEF DESCRIPTION OF THE DRAWINGS

These and other objects, aspects and embodiments of the present invention will be described in more detail with reference to the following drawings, in which:

FIG. 3 is an illustrational view of the air compression type shooting device;

FIG. 4 is an enlarged illustrational view of the bullet according to the present invention;

DETAILED DESCRIPTION OF THE PREFERRED EMBODIMENTS

A preferred embodiment of the present invention will now be described with reference to the accompanying drawings.

Figure 1:
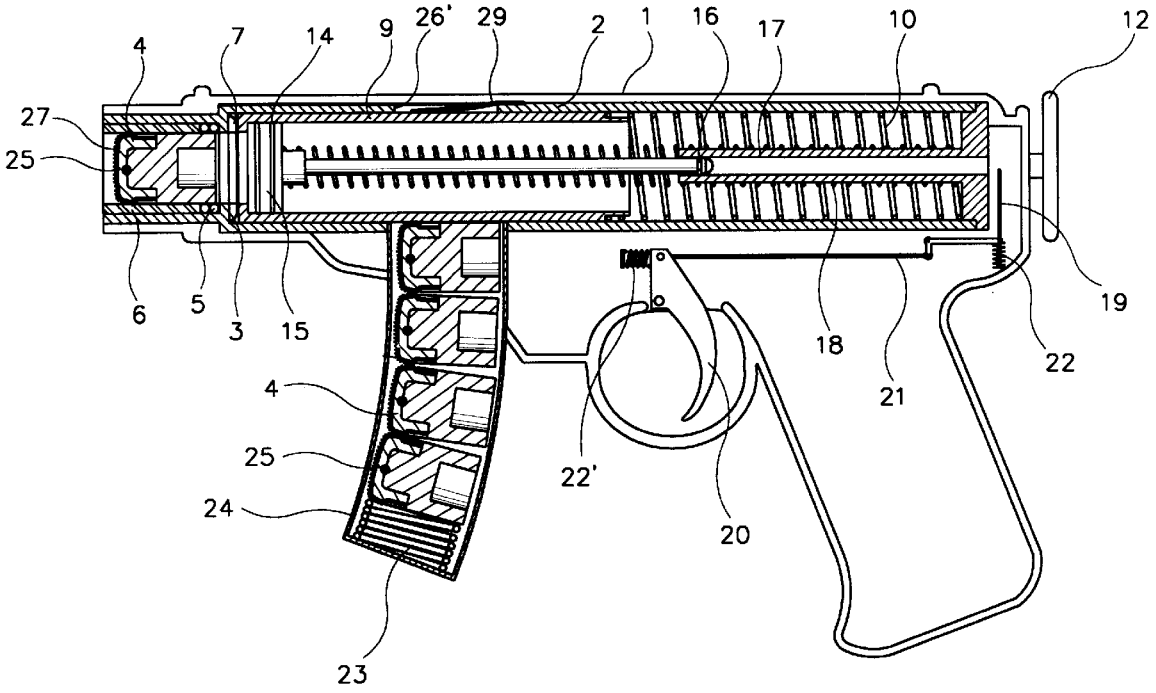
FIG. 1 is a cross sectional view of an air compression type shooting device according to the present invention.
Figure 2:
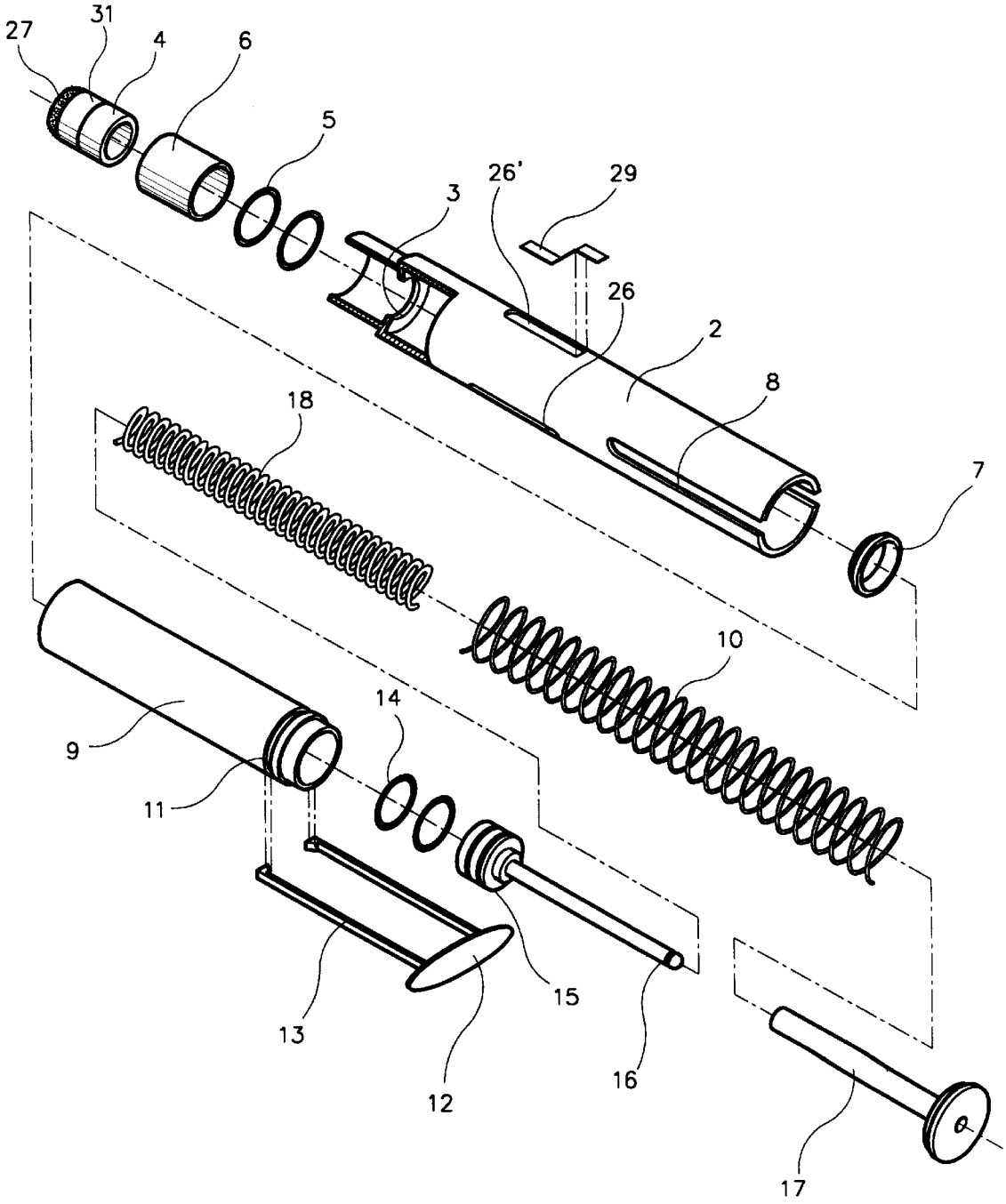
FIG. 2 is an exploded perspective view of the air compression type shooting device showing the inside structure thereof.

FIG. 1 is an entire cross sectional view of an air compression type shooting device according to the present invention, and FIG. 2 is an exploded perspective view of the air compression type shooting device showing the principal structure thereof.

A fixed compression tube 2 is mounted inside a body 1 of the air compression type shooting device in the form of the gun. The fixed compression tube 2 is provided at the end of a projection jaw 3 with a rubber ring 5 of which the inner diameter is less than the outer diameter of a bullet 4, which is engaged with the fixed compression tube 2 by means of a fixing bushing 6 of which the inner diameter is larger than that of rubber ring 5.

A shock-absorbing rubber packing 7 of which the inner diameter is larger than the outer diameter of the bullet 4 is mounted in contact with the projection jaw 3. The fixed compression tube 2 is formed at the circumferential wall with guide holes 8. A bullet inlet 26 which a magazine 24 is inserted through is formed both at the central bottom of the fixed compression tube 2 and the central bottom of the body 1. On the opposite of the bullet inlet 26, an elastic guide plate 29 is fixed to the inside of a guide hole 26'.

A movable compression tube 9 which moves back and forth is inserted into the inner surface of the circumferential wall in the rear of the projection jaw 3 of the fixed compression tube 2, of which the rear portion is biased by means of a spring 10. The movable compression tube 9 is formed at both outer surfaces with the holding grooves 11 in which two opposite links 13 of the rear grip 12 of body 1 are engaged.

A piston 15 having an end covered with compression rings 14 is inserted into the inside of the movable compression tube 9. The piston has a holding jaw 16 formed at the rear end thereof, which is inserted into the guide tube 17 fixed movably back and forth to the rear end of the fixed compression tube 2, and biased by means of the spring 18.

To the rear outer end of the fixed compression tube 2 is provided a triggering unit comprising a latch 19 for holding the holding jaw 16 of the rear end of the piston 15, a trigger 20 for triggering the latch 19, a connecting rod 21 for connecting the latch 19 with the trigger 20, and springs 22 and 22'.

The operation of the air compression type shooting device according to the present invention will now be explained with reference to FIGS. 3*a* to 3*c*.

Figure 3A:
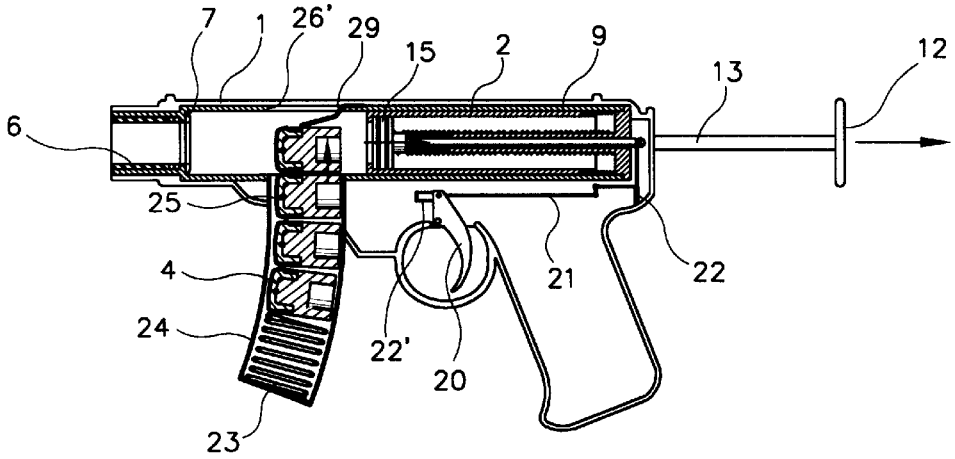
FIG. 3*a* shows the state when the air is inhaled.

FIG. 3*a* shows the state when the air is inhaled to use the shooting device in the form of the gun according to the present invention. As the grip 12 formed at the outer rear end of the body 1 of the shooting device is pulled rearwards, the balance in rearward movement of the movable compression tube 9 is maintained with accuracy and the force for pulling the grip rearwards is minimized, since the two opposite link 13 is engaged with the holding groove 11 through the guide holes 8 of the fixed compression tube 2. Consequently, the piston 15 arranged therein is also moved rearwards against the elastic force of the spring 18 such that the outside air is inhaled into the fixed compression tube 2. At the same time, the holding jaw 16 of the rear end of the piston 15 is held by means of the latch 19 of the triggering unit such that the piston 15 moved rearwards is maintained in the stationary state. The guide plate 29 hidden in the fixed compression tube 2 and the guide hole 26' is projected at the one end thereof into the inside of the fixed compression tube 2 by means of the elastic force thereof.

At this time, the bullet 4 mounted in the magazine 24 is risen by approximately ⅓ into the bullet inlet 26 by means of the force of the spring for receiving the bullet at the ready.

Figure 3B:
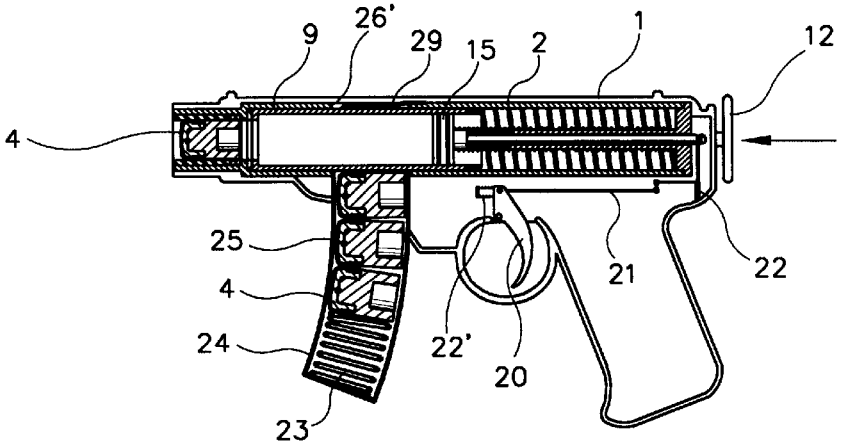
FIG. 3*b* shows the state when the bullet is inhaled.

FIG. 3*b* shows the state when the bullet is inserted.

In the state that the air is inhaled as mentioned above, when the grip 12 is released, the movable compression tube 9 arranged between the piston 15 and the fixed compression tube 2 is moved forwardly again by means of the elastic force of the spring 10 maintaining the stationary state by means of the holding force of the holding jaw 16. As a result, the grip 12 is returned to the original state, not pulled rearwards. Therefore, when the bullet is discharged, the sudden movement of the grip 12 is avoided, thereby the safety accident is prevented. At this time, although the movable compression tube 9 is moved forwardly, the air to be compressed is not escaped, the damage of the components is prevented, and the noise due to the collision is reduced by means of the shock-absorbing rubber packing 7.

At this time, when the movable compression tube 9 is moved forwardly, the front surface of the movable compression tube 9 pushes the rear surface of the bullet risen by approximately ⅓ into the bullet inlet 26 in the central bottom of the fixed compression tube 9. Consequently, the bullet 4 is passed accurately through the shock-absorbing rubber packing 7 by the means of the guide of the guide plate 29, and the rear surface of the bullet 4 is in tight contact with the rubber ring 5, then is engaged with the rubber bushing 6. Now the discharging is ready.

Although it is constructed to form the guide plate 29, the guide hole 26' can also function as means for preventing the bending of the fixed compression tube 2 by the bullet inlet 26 when the fixed compression tube 2 made of synthetic resin is formed.

Figure 3C:
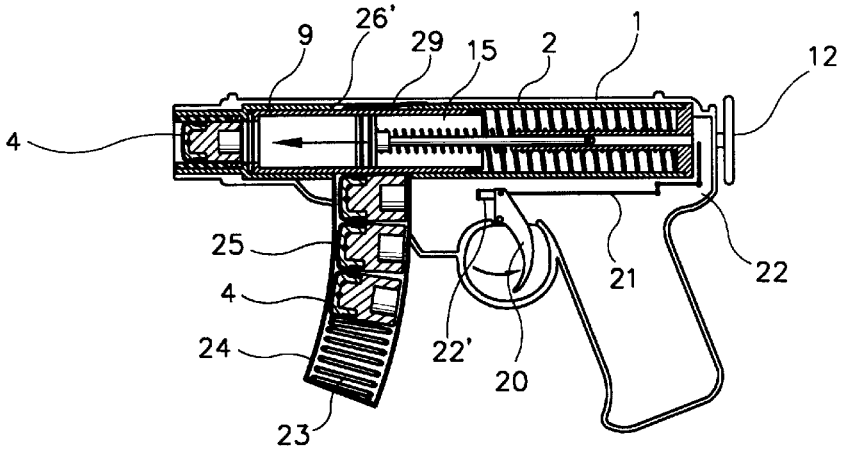
FIG. 3*c* shows the state when the air is compressed.

FIG. 3*c* shows that the bullet is discharged by means of the compression of the air due to the forward movement of the piston 15.

When the trigger 20 is actuated after aiming at the target, the latch 19 of which the holding force is maintained by means of the elastic force of the spring 22 through the connection of the connecting rod 21 moves down to release the holding force against the holding jaw 16 of the piston 15. Consequently, the piston 15 moves forwardly by means of the elastic force of the spring 18 to compress the air in the movable compression tube 9.

At this time, since the bullet 4 having a weight 25 inserted into the inner center of the its head is caught tightly by the rubber ring 5, it does not escape from the fixed compression tube 2 until the air is compressed to desired pressure. When the compression of the air reaches the predetermined limits, the compressed air is exploded momentarily, by which the bullet 4 is discharges. Therefore, the speed of discharge becomes increased, the hitting rate becomes high, and the distance of discharge becomes long.

With the prior art, it has an problem that the air loss is caused since there are some gaps between the bullet and the inner wall of the shooting tube. On the contrary, with the present invention, there are no loss of the compressed air since the outer surface of the bullet 4 is engaged tightly with the inner surface of the rubber ring 5 to maintain a desired air pressure. Consequently, when the air is compressed beyond the predetermined air pressure, the engaging force between the bullet 4 and the rubber ring 5 is released, so that the bullet 4 is discharged momentarily.

In addition, since the velcro fabrics 27 are attached only to one side of the bullet 4, it has no effect on airtightness between the bullet 4 and the rubber ring 5, and the discharged bullet 4 can be attached to the target made of the velcro fabrics.

Figure 4A:
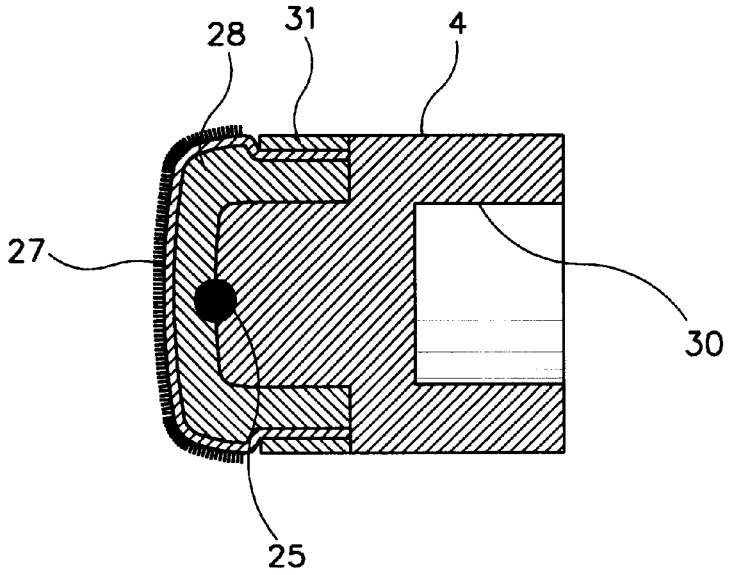
FIG. 4*a* shows the cross section of the bullet according to the present invention.

Such a bullet according to the present invention is illustrated in FIG. 4*a*. A concave groove 30 is formed at the rear end of the bullet 4. Shock-absorbing materials 28 is inserted into the head of the bullet 4, of which circumference is covered with the velcro fabrics 27. A fixing ring 31 is provided at the upper portion thereof for holding the velcro fabrics 27.

With the bullet 4 constructed as mentioned above, the straightness to the air expansion is improved by virtue of the concave groove 30, the weight of the bullet is reduced. The flexible shock-absorbing materials 28 can absorb the shock when the bullet 4 is run against the wall or the target, so that the human body or the fragile article is protected safely. The bullet 4 can be attached to the target made of velcro fabrics since the bullet 4 has a corresponding portion made of velcro fabrics, to confirm whether the bullet 4 hits the target.

Figure 4B:
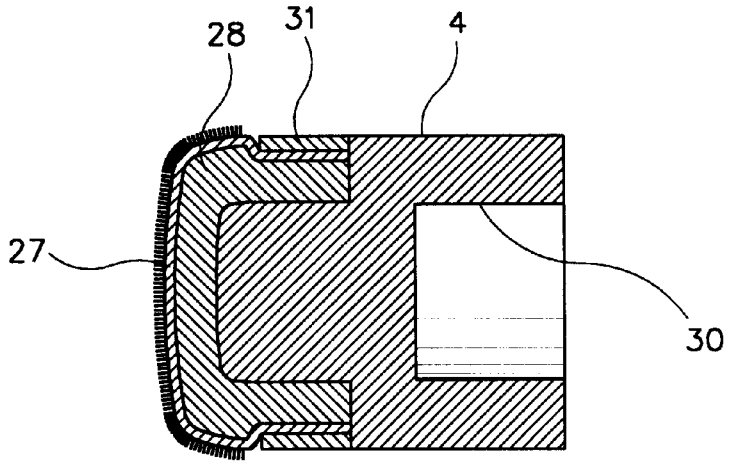
FIG. 4*b* shows another embodiment of the bullet according to the present invention.

Furthermore, it is possible to insert the weight 25 into the inner center of the head of the bullet 4, as shown in FIG. 4*b*, in order to increase the straightness and the distance of discharge.

As described above, the air compression type shooting device according to the present invention has several advantages in that it is possible to confirm the point of impact, so that the interest is increased, that it is convenient and safe to use the absorption type bullet, and that it is possible to increase the hitting rate and the distance of discharge with the weight inserted in the bullet, so that both interest and safety are increased much more.

While a preferred embodiment has been described, variations thereto will occur to those skilled in the art within the scope of the present inventive concepts which are delineated by the following claims.

What is claimed is:

1. An air compression type shooting device using an absorption type bullet comprising: a fixed compression tube (2) having a rubber ring (5) for holding a bullet attached to the front side of a projection jaw (3) at the end thereof; a movable compression tube (9) placed movably back and forth by a rear grip (12) and a spring (10) in the fixed compression tube (2); a piston (15) biased by a spring (18) in the movable compression tube (9) and moved back and forth in a guide tube to inhale and compress the air; and a triggering unit for holding and releasing the piston (15), the upper portion of a magazine (24) in which a plurality of the bullets 4 are loaded being engaged into a bullet inlet (26) beneath the movable compression tube (9), to the inner side of guide hole (26') opposite thereto being fixed upwardly a guide plate (29).

2. The air compression type shooting device using an absorption type bullet as claimed in claim 1, wherein the inner diameter of the rubber ring (5) is smaller than the outer diameter of the bullet (4), the rubber ring and the bullet being engaged with each other by means of a fixing bushing (6) having the inner diameter larger than the outer diameter of the bullet (4).

3. The air compression type shooting device using an absorption type bullet as claimed in claim 1, wherein a shock-absorbing rubber packing (7) is provided to the rear side of a projection jaw (3) at the end of the fixed compression tube (2), so that the shock against the movable compression tube (9) is relieved and the leakage of the air is prevented.

4. The air compression type shooting device using an absorption type bullet as claimed in claim 1, wherein the movable compression tube (9) and the piston (15) are biased by different springs (10, 18) respectively, so that the movable compression tube and the piston are advanced in respective stroke.

5. The air compression type shooting device using an absorption type bullet as claimed in claim 1, wherein the guide plate (29) is made of elastic materials, and the guide plate appears or disappears by means of the back and forth movement of the movable compression tube (9).

6. The air compression type shooting device using an absorption type bullet as claimed in claim 1, wherein the bullet (4) is provided at one side thereof with a concave groove (30), and the bullet (4) is provided at the other side thereof with a hemispherical elastic shock-absorbing material (28), of which the circumference is covered with velcro fabrics (27), the velcro fabrics being fixed by means of the fixing ring (31) provided at the edge of the circumference.

7. The air compression type shooting device using an absorption type bullet as claimed in claim 6, wherein a weight (25) is inserted into the bullet (4).

* * * * *